United States Patent [19]

Patterson et al.

[11] Patent Number: 4,744,420

[45] Date of Patent: May 17, 1988

[54] WELLBORE CLEANOUT APPARATUS AND METHOD

[75] Inventors: John C. Patterson, Plano; David D. Hearn, Richardson, both of Tex.

[73] Assignee: Atlantic Richfield Company, Los Angeles, Calif.

[21] Appl. No.: 76,565

[22] Filed: Jul. 22, 1987

[51] Int. Cl.[4] ..... E21B 37/00

[52] U.S. Cl. ..... 166/312; 166/106; 166/105; 175/67

[58] Field of Search ..... 166/312, 106, 222, 223, 166/68, 105; 175/67, 424

[56] References Cited

U.S. PATENT DOCUMENTS

| | | | |
|---|---|---|---|
| 3,007,526 | 11/1961 | Tausch | 166/312 X |
| 3,020,958 | 2/1962 | Kenneday | 166/312 X |
| 3,662,828 | 5/1972 | Hutchison | 166/312 |
| 4,088,191 | 5/1978 | Hutchison | 166/223 |
| 4,183,722 | 1/1980 | Roeder | 166/106 X |
| 4,293,283 | 10/1981 | Roeder | 166/106 X |
| 4,603,735 | 8/1986 | Black | 166/68 |
| 4,658,893 | 4/1987 | Black | 166/68 |
| 4,671,359 | 6/1987 | Renfro | 166/223 X |

*Primary Examiner*—Stephen J. Novosad
*Attorney, Agent, or Firm*—Michael E. Martin

[57] ABSTRACT

Sand is evacuated from horizontal and vertical wellbores utilizing a jet pump connected to the distal end of a concentric tubing string which is insertable in the wellbore and extendable from the earth's surface or from a seal member providing a crossover flow path between the wellbore annulus above the seal member and the inner tubing member of the concentric tubing string. The jet pump includes a plurality of nozzles for ejecting evacuation of fluid into the wellbore to agitate and entrain accumulated solids for flow into a pump inlet cavity and to be propelled out of the pump by a portion of the evacuation fluid acting as a jet pump power fluid. The inner tubing member may be coilable tubing which is inserted into the outer tubing member after the jet pump has been lowered into the wellbore. An upper portion of the concentric tubing string may be made up of preassembled sections of the inner and outer tubing members. One embodiment of the seal member is an inflatable packer utilizing evacuation fluid as the seal element inflation medium.

17 Claims, 5 Drawing Sheets

WELLBORE CLEANOUT APPARATUS AND METHOD

BACKGROUND OF THE INVENTION

1. Field of the Invention

The present invention pertains to methods and apparatus for injecting fluids to evacuate accumulations of sand and other solids from vertical and, particularly, generally horizontal wellbores.

2. Background

Various devices and systems have been developed for evacuating accumulations of sediment and other solids from oil and gas wells. One improvement in wellbore cleanout equipment and techniques is described and claimed in U.S. Pat. No. 4,671,359 to J. J. Renfro and assigned to the assignee of the present invention. In the system described in the Renfro patent, elongated coilable tubing is inserted into the well through a tubing string and quantities of evacuation fluid are jetted into the wellbore to create sufficient velocity to carry the accumulations of sand and other solids upward through the annulus formed between the outer tubing string and the coilable tube.

However, the increasing development of highly deviated and so called horizontal wellbores has presented certain problems in well cleanout operations in that the direction and velocity of flow of the solids evacuation fluid, using conventional methods and equipment, cannot overcome the forces acting to cause the sand and solids to settle out in the wellbore. Still further, the development of deeper wells has presented certain problems in providing sufficient flow velocity of the solids evacuation fluids without incurring extremely high pumping pressures.

Accordingly, the present invention has been directed to developing improved wellbore cleanout apparatus and methods which are adapted to be used in generally horizontal or highly deviated wellbores, as well as vertical extending wellbores, and which overcome certain problems, including those associated with pumping sufficient quantities of solids evacuation fluids in relatively deep or small diameter wells without incurring fluid flow losses and reduced fluid velocities which are ineffective to perform the required cleaning effect.

SUMMARY OF THE INVENTION

The present invention provides improved wellbore cleanout apparatus for removing accumulations of sand and similar solids by the circulation of a solids evacuation fluid through the portion of the wellbore to be cleaned, and which apparatus is particularly adapted for horizontal or highly deviated wellbores as well as vertical wellbores.

In accordance with one aspect of the present invention, a wellbore cleanout apparatus is provided which utilizes a so-called jet pump of unique configuration which provides for agitation and fluid entrainment of sand and other solids accumulating in a region of a wellbore into which the pump is inserted. The improved jet pump of the present invention preferably includes a pump body having an array of jet nozzles which are operable to eject fluid into the wellbore to agitate accumulations of solids and entrain the solids for flow into the jet pump inlet which is centrally located at one end of the pump. The jet pump utilizes a portion of the evacuation fluid as the driving or motive fluid for entrainment of solids laden evacuation fluid jetted into the wellbore itself. The jet pump is adapted to be positioned in a wellbore connected to a concentric tubing string for conducting fluid to and from the wellbore by way of the jet pump.

In accordance with another aspect of the present invention, the jet pump and a dual concentric tubing string are disposed in the wellbore and operably connected to a sub which serves as a seal between the portion of the wellbore to be cleaned out and further portions of the wellbore so as to minimize the flow path length of the fluid being evacuated which is subject to a constrained or reduced cross sectional flow area and thereby minimize pumping losses and maintain sufficient fluid velocities in the wellbore. The fluid transfer and seal arrangement may include resilient seals of the swab cup type or an arrangement which includes an inflatable packer which is operated to seal the wellbore, utilizing the solids evacuation fluid.

In accordance with yet another aspect of the present invention, there is provided a unique concentric tubing string particularly adapted for use in connection with a wellbore solids evacuation fluid system. The present invention still further provides an improved arrangement of a concentric tubing string and means for connecting the tubing string to a wellbore seal, such as the abovementioned swab cup sub or inflatable packer.

In accordance with still further aspects of the present invention, apparatus and methods are provided for evacuating collections of solids in wellbores, including generally horizontal wellbores, wherein an improved jet pump is inserted into the wellbore and connected to a concentric tubing string for conducting fluid to and from the wellbore portion to be evacuated. The concentric tubing string is extended to the wellhead or is connected to a unique seal member disposed in a generally vertical portion of the wellbore to provide for conducting fluid out of the wellbore through a less restricted flow path to minimize fluid flow losses and to maintain sufficient fluid pressure in the wellbore portion being cleaned.

Those skilled in the art will recognize the abovedescribed features and advantages of the present invention together with other superior aspects thereof upon reading the detailed description which follows in conjunction with the drawing.

DESCRIPTION OF PREFERRED EMBODIMENTS

Figure 1:
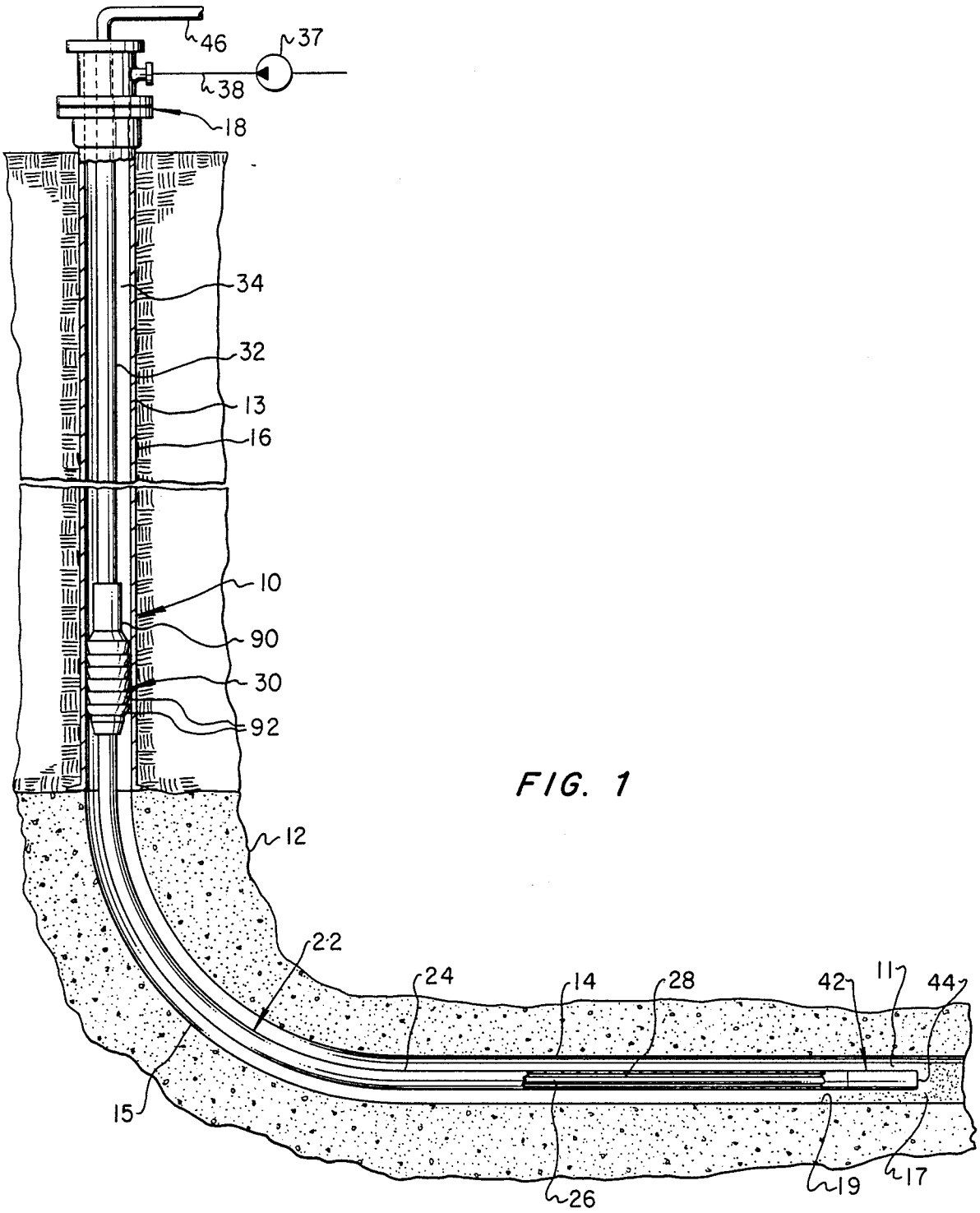
FIG. 1 is a vertical section view in somewhat schematic form showing the installation of one embodiment of a wellbore cleanout apparatus or system in accordance with the present invention.

In the description which follows, like parts are marked throughout the specification and drawing with the same reference numerals, respectively. The drawing figures are not necessarily to scale and certain feature of the invention may be shown exaggerated in scale in the interest of clarity and conciseness.

Referring to FIG. 1, there is illustrated the extension of a wellbore 10 into an earth formation 12 wherein a portion of the wellbore becomes deviated from the vertical into a substantially horizontal direction, which portion is designated by the numeral 14. With the development of certain types of oil and gas reserves, it has become advantageous to extend wellbores in generally horizontal directions to take advantage of the length of the wellbore exposed to the hydrocarbon rich portion of the formation, to penetrate plural vertical fractures in certain types of formations and to avoid developing so-called coning effects in producing certain types of reservoirs. The wellbore 10 is provided with a conventional casing 16 extending through the vertical portion 13 of the wellbore and terminated at the earth's surface in a conventional wellhead 18. The wellhead 18 is adapted to provide for the insertion and withdrawal of certain types of tubing strings which will be described further in detail herein and utilizing conventional tubing string or pipe handling equipment, including coiled tubing injection and withdrawal apparatus such as illustrated by way of example in U.S. Pat. No. 4,671,359. Accordingly, it is believed that one of ordinary skill in the art of wellbore cleanout operations will be familiar with the various types of tubing and pipe handling and injection equipment and such will not be described in further detail herein.

The wellbore portion 14 includes an area 11 in which a collection of unwanted quantities of sand, fracture proppant or similar solids materials 17 have accumulated and impedes the production of fluids or the further injection of fluids with respect to formation 12. Accordingly, it is contemplated that removal of the accumulation of sediments, sands and other solids 17 must be carried out to make further operations in the wellbore 14 feasible. As mentioned previously, one problem with evacuating solids which have collected in generally horizontal or highly deviated wells pertains to the problem of maintaining sufficient fluid velocity in the horizontal or deviated wellbore portion to carry sand and sediments into a fluid evacuation conduit since, typically, the forces acting on the entrained solid particles are generally normal to the direction of flow of fluid and the particles tend to settle out on the so-called bottom side 19 of the wellbore.

The aforementioned problem, as well as others described herein, may be overcome with an apparatus which includes an elongated concentric tubing string, generally designated by the numeral 22. The tubing string 22 includes an outer fluid conducting tube 24 and an inner tube 26. The inner tube 26 provides a first fluid flow path and the annular space 28 between the outer tube 24 and the inner tube 26 provides a second flow path for solids evacuation fluid. The tubing string 22 is operably connected to a seal member 30 which is disposed in the wellbore portion 13 and is shown in substantially fluid tight sealing engagement with the casing 16. A second, single conductor tubing string 32 extends from the seal member 30 to the wellhead 18, provides a fluid flow path and defines, in part, an annular flow area 34 within the casing 16, which is also operable to conduct fluid for the solids evacuation operations.

The system illustrated in FIG. 1 provides for conducting a fluid such as treated water from a source including a pump 37 into the wellbore portion 14 through a conduit 38 connected to the wellhead 18 for flow down through the annular flow path 34 to the seal member 30, wherein the fluid is then conducted from the seal member through the annular flow passage 28 formed within the tubing 24 through the tubing string 22 to the distal end thereof where the tubing string is connected to a unique jet pump, generally designated by the numeral 42. The fluid conducted down to the jet pump 42 is generally considered a "power" fluid for operating the pump. However, at least a portion of the fluid is utilized as a solids evacuation fluid and is forcibly ejected from the end 44 of the pump 42 to thoroughly agitate and entrain solids 17 which have accumulated in the wellbore and where in the fluid and entrained solids flow into the pump 42 and the tubing 26 for conduction back to the seal member 30 and then into the tubing string 32 for return to the surface by way of a discharge conduit portion 46 connected to the wellhead 18. Accordingly, fluid may be conducted down to the seal member 30 through a substantially unrestricted flow path provided by the relatively large diameter annular space 34, then through the annular area 28 to the jet pump 42 and, laden with entrained solids, returned to the seal member through the tubing 26 whereupon the fluid is then conducted into the relatively large diameter tubing string 32 for return to the surface. Accordingly, only the deviated or somewhat horizontally extending work area of the wellbore 10 provides a relatively restricted flow path for the evacuation fluid throughout the complete circuit of fluid flow. The relatively restricted fluid flow path in the horizontal portion of the wellbore is desirable to maintain fluid flow velocities sufficient to prevent settling of entrained solids. On the other hand, fluid flow velocity upward through the wellbore portion 13 is not required to be as great as in the wellbore portion 14 in order to evacuate solids entrained in the fluid.

Figure 2:
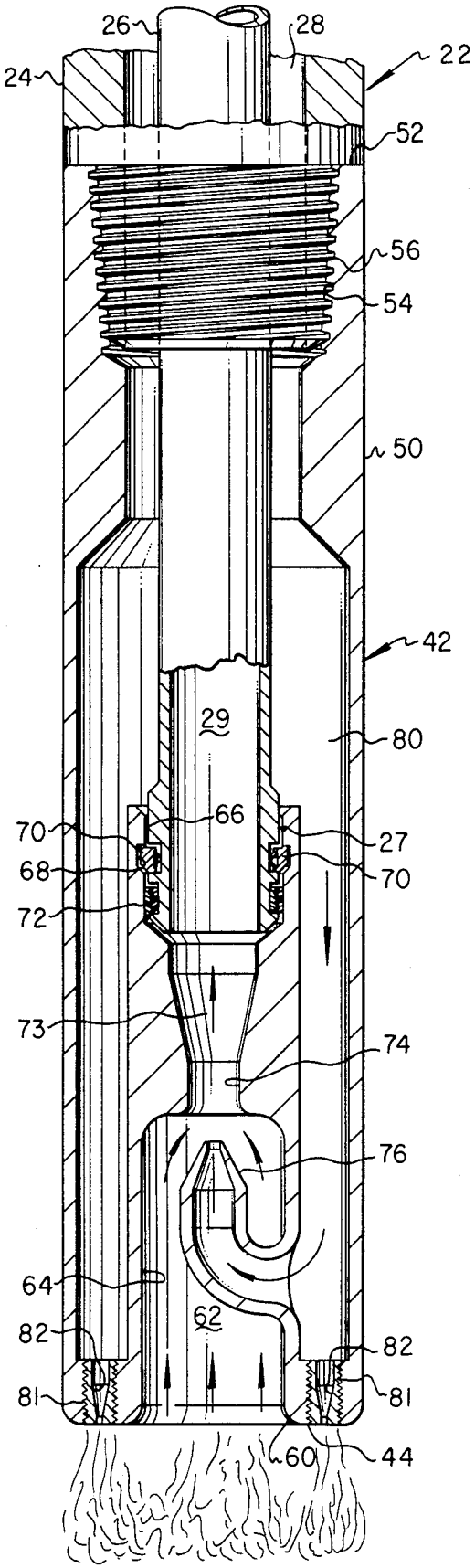
FIG. 2 is a longitudinal central section view of an improved wellbore jet pump in accordance with the present invention.

Referring now to FIG. 2, there is illustrated a section view of the improved jet pump 42. The pump 42 includes a generally cylindrical body 50 having an end 52 which is suitably threaded at 54 to receive a coupling portion 56 of the tubing string 22. The opposite end 44 of the body 50 includes a relatively large diameter central opening 60 formed therein opening into a fluid inlet cavity 62. The cavity 62 is defined in part by an inner generally concentric body portion 64 which extends partially toward the end 52 and includes a receiver bore 66 for receiving the end 27 of the inner tube 26. The receiver portion 66 includes a suitable annular recess 68 for receiving radially retractable latching members 70 of conventional construction which are suitably disposed on the tubing end portion 27. An annular resilient seal 72 is also disposed on the tubing end 27 for sealing engagement with the bore 66, whereby the tubing 26 may be latched in sealing connection with the pump body portion 64. The receiver bore 66 is in communication with a diffuser 73 including a reduced diameter throat portion 74 which opens into the inlet cavity 62. A nozzle 76 extends into the cavity 62 and is aligned with the diffuser throat 74 for entraining fluid entering the cavity 62 for discharge through the diffuser 73 into a passage 29 formed in the tubing 26.

The pump inner body 64 and the tubing 26 form an annular flow passage 80 within the pump body 50 which is in communication with a generally circular array of jet nozzles 81 comprising respective convergent passages 82 formed in removable nozzle inserts each of which opens into the annular passage 80. The nozzle passages 82 provide for acceleration of fluid pumped into the annular passage 80 by way of the concentric tubing string 22 for high velocity ejection from the end 44 to substantially agitate and entrain solids into a flow stream which develops from conducting at least a portion of the fluid entering the passage 80 through the nozzle 76. Accordingly, the working evacuation fluid conducted into the wellbore portion 14 through the passage 28 and the passage 80 is utilized to provide driving fluid for the jet pump 42 and a portion of the working fluid is ejected through the nozzles 81 to agitate and entrain solids which have accumulated in the wellbore for flow out of the wellbore portion through the tubing string 26 back to the seal member 30 and then through the tubing string 32 to the wellhead 18.

Figure 3:
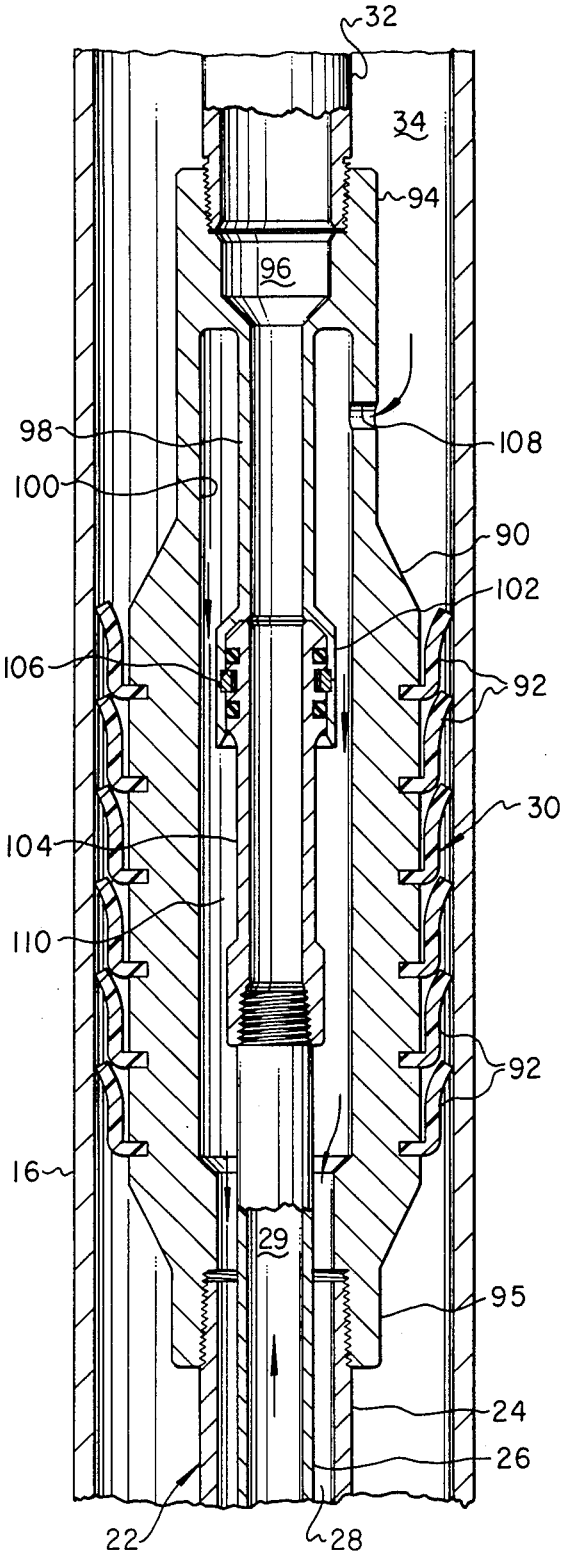
FIG. 3 a longitudinal central section view of a wellbore fluid conduit and seal device in accordance with the present invention.

Referring now to FIG. 3, the seal member 30 is shown disposed in the wellbore casing 16 connected to the tubing string 32 and the tubing string 22. The upper portion of the wellbore 13, including the passage 34, is isolated from the lower portion 14, including a curved or transition portion 15, FIG. 1, by the seal member 30. The seal member 30 includes a generally cylindrical body or mandrel 90 on which a plurality of resilient cup-like annual seal members 92 are disposed and adapted to be in sealing engagement with the inner wall surface of the casing 16. The pressure of fluid being pumped downhole through the passage 34 tends to bias the seal members 92 ever tighter into sealing engagement with the casing 16 to isolate the wellbore portion 14, 15 from the passage 34.

The body 90 includes an upper end 94 which is suitably connected to the tubing string 32 and a flow passage 96 defined in part by a conduit 98 extending within a hollow cavity 100 formed in the body 90. The conduit 98 has a lower enlarged diameter end portion 102 which is adapted to receive a special tubing adaptor 104 for a purpose to be described in further detail herein. The lower end of the body 90 includes a suitably threaded coupling portion 95 for connecting the seal member to the tubing string 22 through the outer tubing member 24. The upper end of the tubing 26 is suitably adapted to be connected to the lower end of the tubing adaptor 104 prior to insertion of the adaptor into the enlarged diameter portion of the conduit 102, as illustrated. The adapter 104 may include suitable latching dogs 106 engageable with the conduit portion 102 to secure the tubing 26 to the seal member 30. One or more transverse fluid inlet ports 108 are formed in the body 90 and open in to an annular passage 110 which is in communication with the annular passage 28 formed in the tubing string 22. Alternatively the upper end of the tubing 26 may be secured in a suitable socket, by retaining screws or the like, not shown, which socket could be formed on the lower end of the conduit 98.

The apparatus illustrated in FIGS. 1, 2 and 3 may be made up to provide for wellbore cleanout operations for removing solids 45 from the wellbore portion 14 generally in accordance with the following method. Referring again to FIG. 1, the pump 42 is connected to the lower end of the tubing 24 and run into the wellbore on a sufficient amount of the tubing 24 to be capable of reaching the desired point in the wellbore portion 14 for performing cleanout operations, while also providing for the seal member 30 to be positioned in the vertical, cased portion of the wellbore. The tubing 24 is secured while the tubing 26 is extended within the tubing 24 until the lower end 27 is latched in place in the receiver bore 66, as illustrated in FIG. 2. At this point, the tubing string 22 is made up in the configuration illustrated in FIG. 1, and the tubing 26 is then cut and threaded or otherwise adapted to be secured to the adaptor 104 as shown in FIG. 3. The seal member 30 is then attached to the upper end of the tubing 24 and is operably connected to the tubing 26 through the adaptor 104 so that the conduit 98 is in flow communication with the tubing 26 and the annular flow passage 110 is in communication with the flow passage 28 formed between the tubing 24 and 26. The seal member 30 is then run into the wellbore portion 13 with the tubing string 32 until the pump 42 is in the desired position to begin cleanout operations.

The tubing string 32 is then suitably connected in flow communication with the conduit 46 and circulation of fluid is commenced by pumping fluid through conduit 38, passage 34 and through the cross over point formed by the ports 108, FIG. 3, formed in the seal member 30. Wellbore cleanout fluid is thus conducted down through the annular passage 28 and a portion of the fluid is ejected from the pump 42 through the nozzle passages 82 to agitate and entrain solid particles for flow into the pump inlet cavity 62. Flow of solids laden fluid from the wellbore area 11 into the cavity 62 is induced at least partially by the eductor effect of that portion of the fluid which is conducted through the nozzle 76 to operate the jet pump for entraining fluid flow into the tubing 26 and out of the wellbore through the seal member 30 and the tubing 32. The bottom hole pressure and circulation rate may be controlled by the pump 37, by the ratio of fluid flow conducted to the nozzle passages 82 as compared to flow through the nozzle 76 and by back pressure on the flow through conduit 46. The maximum pressure of the fluid pumped into the cavity 32 is limited to some extent by the pressure rating of the seals 92.

Thanks to the arrangement of the seal member 30 and the concentric tubing string 22, a relatively restricted flow path for the solids evacuation fluid is required only for the length of the tubing string between the seal member 30 and pump 42. Moreover, by conducting the solids evacuation fluid through the tubing string 22, very little fluid flow is lost to the formation 12 through the uncased wellbore 14.

Figures 4, 9:
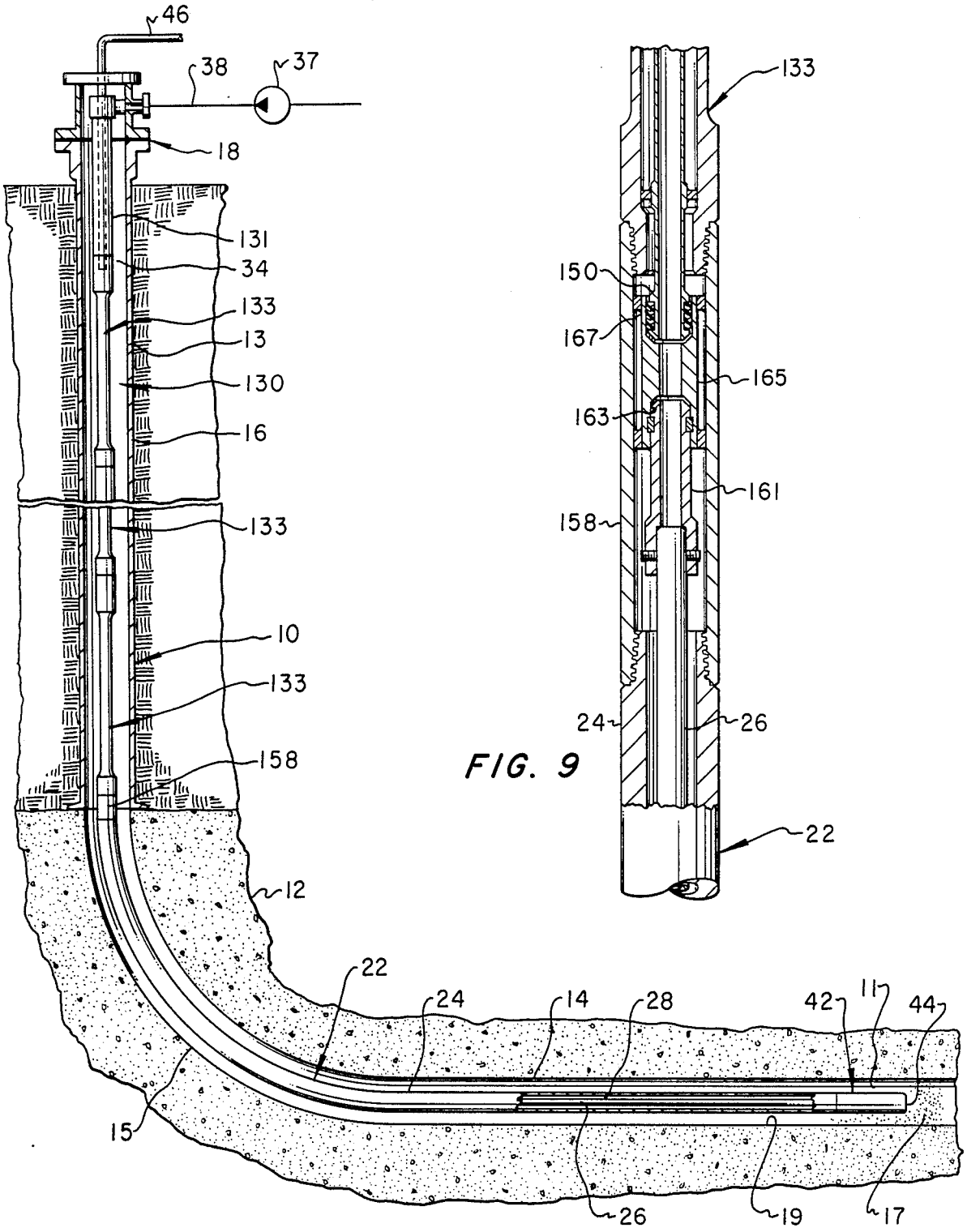
FIG. 4 is a vertical section view in somewhat schematic form of an alternate embodiment of a cleanout apparatus or systems in accordance with the present invention.
FIG. 9 is a longitudinal section view of an adaptor for the tubing strings of the embodiment shown in FIG. 4.
Figure 5:
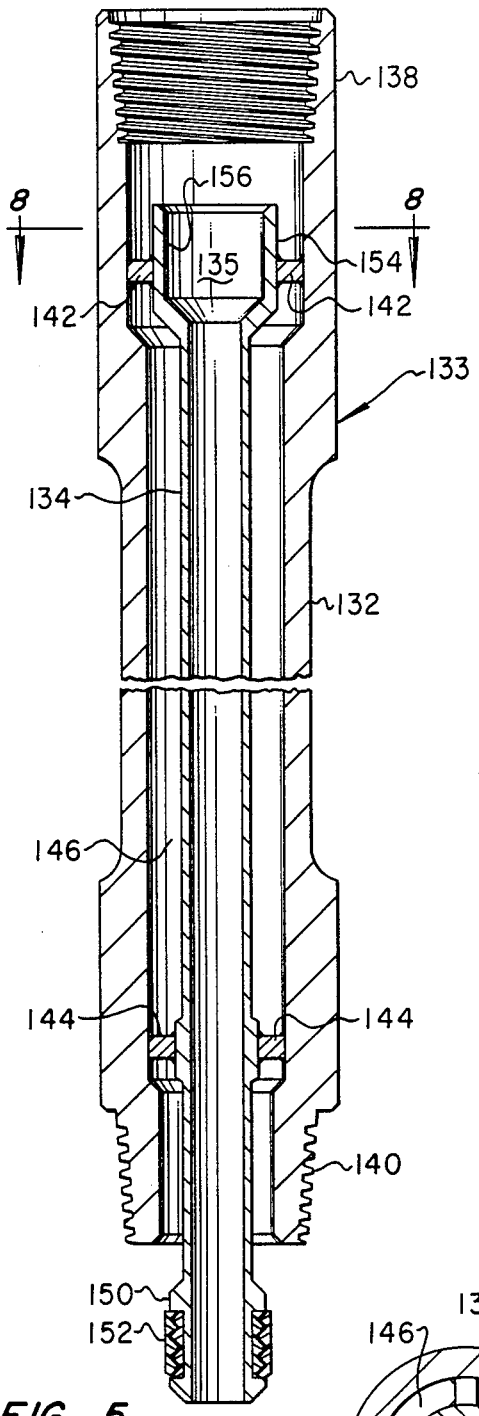
FIG. 5 is a longitudinal central section view of a section of concentric tubing string for use in the apparatus and method of the present invention.
Figure 8:
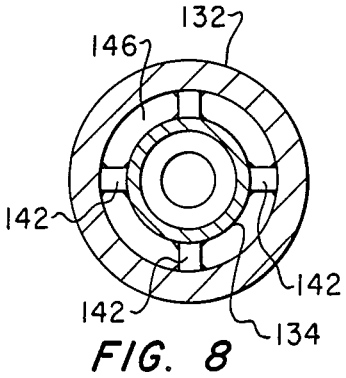
FIG. 8 is a section view taken along line 8—8 of FIG. 5.

Referring now to FIG. 4, an alternate embodiment of an apparatus for cleaning out the wellbore portion 14 is illustrated and includes the tubing string 22 and the pump 42 which are disposed in their working position in the wellbore portion 14 in the same relationship as for the apparatus or system illustrated in FIG. 1. In the arrangement illustrated in FIG. 4, a concentric tubing string is extended throughout substantially the entire wellbore from the wellhead 18 to the pump 42 by the inclusion of a tubing string 130 extending within the vertical or near vertical wellbore portion 13. The tubing string 130 is adapted to be connected at the wellhead 18 to the conduits 38 and 46 by way of a dual conductor conduit member 131. The tubing string 130 includes plural end-to-end connected tubing sections 133 formed by concentric outer tubing members 132 and inner tubing members 134. The tubing sections 133 are further illustrated in FIG. 5 and FIG. 8. The tubing members 132 are conventional enlarged diameter tubing members having suitable threaded box and pin portions 138 and 140, respectively, for coupling the tubing sections 133 in end-to-end relationship. The inner tubing members 134 are secured within the tubing members 132 by spaced apart spoke-like braces 142 and 144 which hold the tubing members 134 generally centered to provide an annular flow passage 146 between the tubing members. The tubing members 134 provide an inner flow passage 135 adapted to be in communication with the flow passage 29 formed by the tubing 26. The tubing members 134 each include special seal head portions 150 having annular resilient seal members 152 disposed thereon and enlarged diameter portions 154 having receiver bores 156 adapted to receive the head portions 150 in sealing engagement therewith to provide a continuous flow passage 135 through the tubing string 130. An adaptor 158 is provided, as shown in FIG. 9, for connecting the tubing 26 to the lowermost tubing member 134 of the tubing string 130. The adaptor 158 is operable to receive a coupling member 161, suitably secured to the tubing 26, in a socket 163 provided in an inner conduit part 165 of the adaptor. The adaptor 158 also includes a receiver portion 167 for receiving the tubing head portion 150.

Accordingly, in the arrangement illustrated in FIG. 4, the pump 42 is run into the wellbore 10 on the tubing 24 until the pump 42 reaches a point in the wellbore at which circulation of fluid to evacuate solids is desired. The tubing 26 is then extended into the tubing 24 and lower end 27 is latched into the receiver bore 66 in the pump 42 in the same manner as described for the embodiment of FIG. 1. The tubing 26 is then cut and connected to the coupling 161, and the adaptor 158 is secured to the tubing string 22 followed by connection of the tubing string 22 to the tubing string 130. After suitable assembly of the conduit 131 with the wellhead 18, fluid is conducted to the pump 42 through a suitable annular passage in the conduit 131, the annular passages 146 and 28 to the pump 42. Solids laden fluid is returned from the pump 42 through the passage 29 formed by the tubing 26, the passages 135 formed in the inner tubing members 134 and an inner conductor of the conduit 131 to the conduit 46. If it is desired to go deeper into the wellbore as solids are removed therefrom, additional tubing sections 133 may be added to the tubing string 130 in a conventional manner as the pump 42 is extended further into the wellbore 14, for example. The tubing sections 133 may, for example, be made up in conventional thirty foot lengths so that the wellbore may be cleaned out in incremental lengths of thirty feet before additional tubing sections are added to the tubing string 130. Accordingly, the apparatus illustrated in FIGS. 4 and 5 may be utilized wherein the pump 42 is likely to be traversed over a substantial portion of the wellbore and it is desired to isolate the flow of solids evacuation fluid from the upper regions of the wellbore, such as when the wellbore portion 13 cannot be adequately sealed or when sufficient fluid velocity cannot be generated to lift solids through the wellbore annulus.

Figure 6:
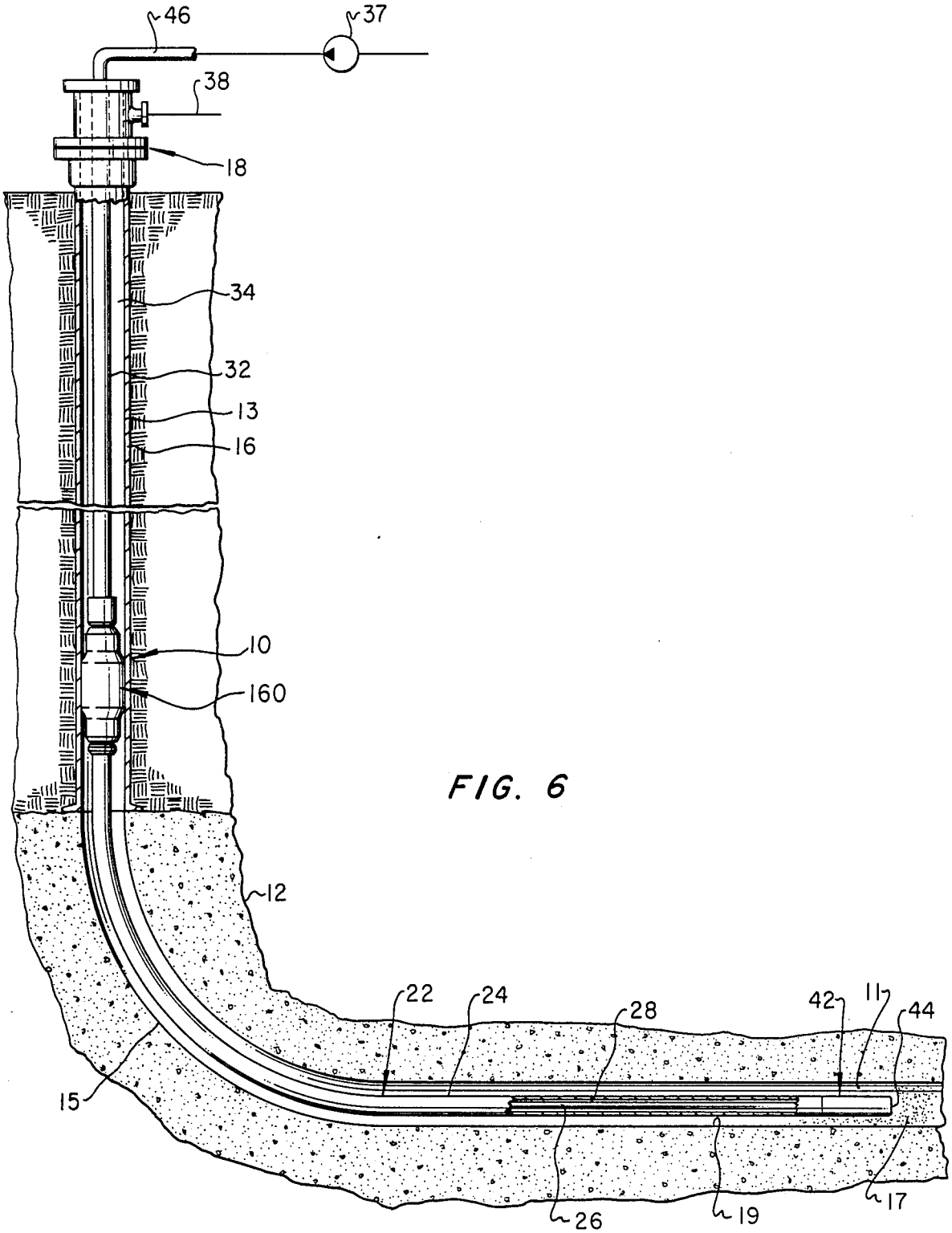
FIG. 6 is a vertical section view in somewhat schematic form showing a second alternate embodiment of the apparatus of the present invention.

Referring now to FIG. 6, a second alternate embodiment of an apparatus or system for evacuating solids from wellbores is illustrated and comprises the pump 42, the tubing string 22 and a unique seal member, generally designated by the numeral 160. The seal member 160 is connected to the tubing string 22 and to the tubing string 32 extending to the wellhead 18. In the arrangement illustrated in FIG. 6, however, the solids evacuation fluid is conducted from the pump 37 to the seal member 160 through the conduit 46 and the tubing string 32 and is returned, laden with solids, by way of the annular passage 34 to the conduit 38. The flow of evacuation fluid through the tubing string 22 is the same as for the embodiment of FIG. 1, that is evacuation fluid is conducted to the pump 42 through the annular passage 28 and from the pump to the seal member 160 through the tubing 26.

Figure 7:
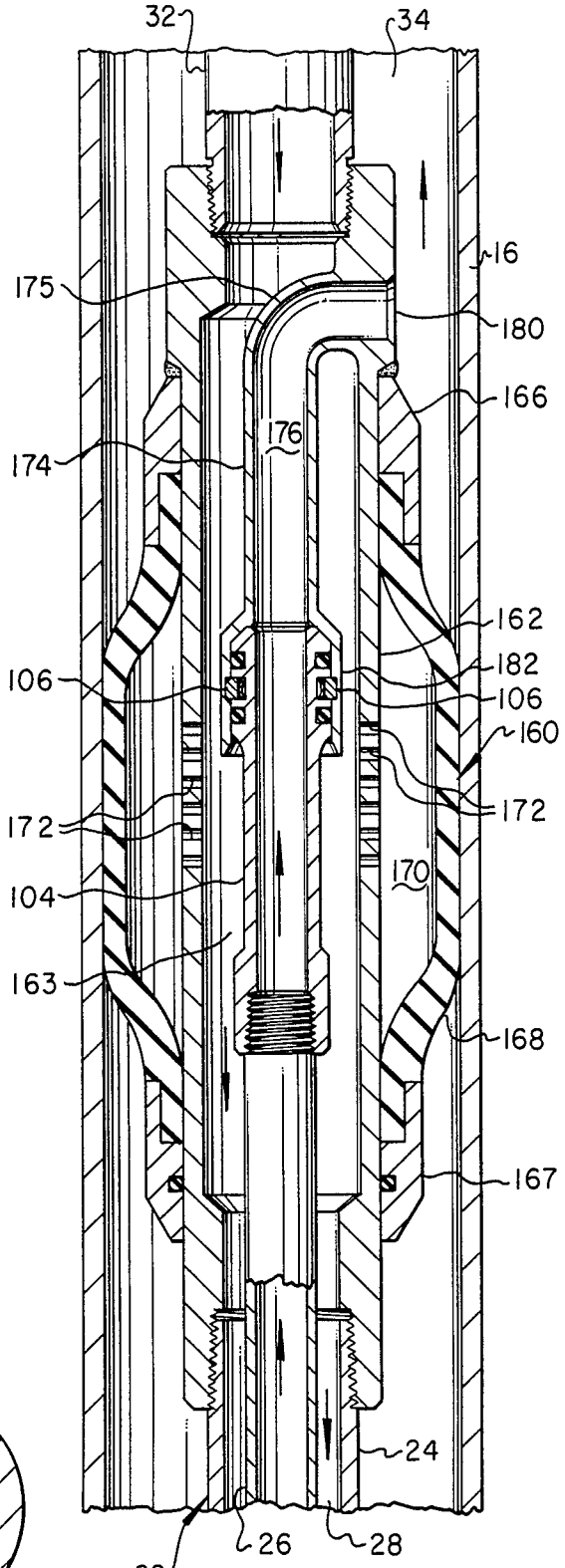
FIG. 7 is a longitudinal central section view of another embodiment of, a wellbore conduit and seal device of the present invention.

Referring also to FIG. 7, the unique seal member 160 is characterized generally as an inflatable packer having a body member 162 forming a substantially rigid conduit section and adapted at its upper end to be threadedly coupled to the tubing string 32 such as by threads 164. The body 162 supports opposed annular collars 166 and 167 which are suitably disposed on the body member 162 and secured to a circumferential annular resilient boot or seal 168. An annular cavity 170 is formed between the exterior surface of the body member 162 and the resilient boot 168 which is operable to be in communication with an interior passage 163 formed by the body 162 by way of one or more ports 172. An elongated conduit portion 174 extends within the passage 163 and is suitably connected to the body 162 at least by way of an elbow portion 175. A flow passage 176 is formed in the conduit 174 which is in communication with the annular passage 34 through a crossover or exit port 180 formed in the sidewall of the body 162. The lower end of the conduit 174 is formed to have an enlarged diameter portion 182 forming a bore for receiving the upper end of a tubing adaptor 104.

Accordingly, the seal member 160 may be operated to radially extend the resilient sealing member 168 into substantially fluid tight sealing engagement with the casing 16 to seal off the wellbore portions 14, 15 from the wellbore portion 13 utilizing the solids evacuation fluid which is conducted down through the tubing string 32 and the passage 163 in the seal member 160 to the annular flow passage 28 provided in the tubing string 22. Solids laden fluid is returned through the tubing 26, the adaptor 104 and the conduit 174 and exits into the annular flow passage 34 at the port 180. Since the relatively large flow area of the passage 34 may result in substantially reduced velocity of fluid carrying solids from the wellbore 14, the solids evacuation fluid may be required to have certain gelling additives mixed therein to prevent settling out of the solids in the passage 34.

The installation of the apparatus illustrated in FIGS. 6 and 7 is similar in some respects to that described for the embodiment illustrated in FIGS. 1 through 3. Briefly, the pump 42 is run into the wellbore 10 on the tubing 24 sufficiently such that the pump 42 and the tubing string 22 will be able to reach the desired point in the wellbore 14 while the seal member 160 is positioned in the generally vertical wellbore 13. The tubing 26 is then inserted into the tubing 24 and latched into the receiver bore 66 on the pump 42. The tubing 26 is then cut and secured to the adaptor 104 and the tubing string 22 is then connected to the seal member 160 in a manner similar to the way in which the tubing string 22 is connected to the seal member 30. The seal member 160 is then lowered into the wellbore portion 13 to a point adjacent to or above the lower end of the casing 16. Solids evacuation fluid is then conducted down through the tubing string 32, the seal member 160 and the tubing string 22. The solids evacuation fluid itself, before entrainment of the solids, serves as a power fluid to activate the seal member 160 to seal off the wellbore annulus forming the passage 34 from the wellbore annulus of the wellbore portions 14, 15, and the solids laden fluid is conducted by the jet pump 42 through the tubing 26 back to and through the seal member 160 and then through the passage 34 to the surface. The seal member 160 is of a type which may withstand higher pressures in the wellbore 10 than may be possible utilizing the seal member 30. Moreover, the annular passage 34 is exposed only to low pressure return fluid while high pressure "power" fluid is conducted downhole through the tubing 32.

The apparatus and methods described in conjunction with FIGS. 1 through 9 herein provide unique processes for evacuating solids which accumulate from various sources within wellbores including, in particular, generally horizontally extending wellbores. Among the advantages of the apparatus and methods described is that these systems may be used to evacuate solids accumulating in wellbores wherein relatively low reservoir pressures exist. For example, conventional circulation requires the formation pressure to be high enough to maintain the pressure generated by the fluid column and the pump pressure. During reverse circulation, the formation must also support the pressure loss of flowing the produced fluid up the tubing string. Thus using conventional circulation methods to remove solids would result in large volumes of fluid being lost to the formation. However, with the methods and apparatus described herein these fluid flow losses are minimized and solids may be easily evacuated from substantially deviated or near horizontal wellbores as well as from generally vertical wellbores.

The apparatus and components described herein may be fabricated using conventional engineering materials normally used for downhole apparatus in oil and gas well operations and the installation procedures, general speaking, are utilized using conventional tubing handling equipment as previously mentioned. Although preferred embodiments of an apparatus and methods for performing wellbore cleanout operations have been disclosed in detail herein, those skilled in the art will recognize that various substitutions and modifications may be made to the specific apparatus described without departing from the scope and spirit of the invention as recited in the appended claims.

What we claim is:

1. Apparatus for evacuating solids such as sediment, sand and the like from a subterranean wellbore, said apparatus comprising:

an elongated tubing string extendable into said wellbore, said tubing string including a first tubing member forming a flow path for conducting solids evacuation fluid to said wellbore and a second tubing member for conducting solids laden evacuation fluid from said wellbore; and pump means operably connected to said first and second tubing members to receive evacuation fluid from one of said tubing members and to conduct solids laden evacuation fluid to the other of said tubing members, said pump means including means for jetting a portion of said evacuation fluid into said wellbore to entrain solids in said evacuation fluid, said pump means being operated by a further portion of said evacuation fluid to discharge solids laden evacuation fluid into said other tubing member for removal of solids from said wellbore.

2. The apparatus set forth in claim 1 wherein:

said first tubing member and said second tubing member are arranged in a concentric tubing string connected to said pump means.

3. The apparatus set forth in claim 2 wherein:

the inner tubing member of said concentric tubing string comprises coilable tubing having means formed on the distal end thereof for inserting said inner tubing member in the outer tubing member of said tubing string and in latching engagement with cooperating means formed on said pump means.

4. The apparatus set forth in claim 1 wherein:

said pump means includes jet nozzle means for ejecting evacuation fluid into said wellbore to entrain said solids in said evacuation fluid, a pump inlet cavity for receiving solids laden evacuation fluid, and eductor nozzle means for propelling solids laden evacuation fluid with another portion of said evacuation fluid.

5. The apparatus set forth in claim 4 wherein:

said pump means includes a generally cylindrical pump body defining in part said inlet cavity, a generally annular passage formed in said body and in communication with one of said tubing members for receiving evacuation fluid to be jetted into said wellbore, said annular passage means being in flow communication with said jet nozzle means, and said eductor nozzle means is in flow communication with said annular passage means and with means forming a diffuser for entraining solids laden evacuation fluid with evacuation fluid received from said annular passage for discharge into said other tubing member.

6. The apparatus set forth in claim 1 including:

a seal member operably connected to said first tubing member and said second tubing member and adapted to be interposed in said wellbore, said seal member including sealing means for engaging a wall surface defining said wellbore to seal off a portion of said wellbore to be evacuated of solids from a further portion of said wellbore.

7. The apparatus set forth in claim 6 wherein:

said seal member includes at least one resilient annular seal element, a body supporting said seal element, means for connecting said body to a portion of said tubing string extending between said seal member and wellhead means, a first conduit extending within said body and including port means opening from the exterior of said body to said first conduit, means for placing said first conduit in flow communication with one of said first and second tubing members, a means forming second conduit extending within said body and adapted to be in communication with the other of said first and second tubing members and with a portion of said tubing string extending between said seal member and said wellhead means for conducting evacuation fluid between said wellbore and said wellhead means.

8. The apparatus set forth in claim 6 wherein:

said seal member includes a body, a resilient annular sealing element disposed around said body and adapted to form a cavity for receiving fluid to urge said element into sealing engagement with a wall surface of said wellbore, means forming a first conduit within said body and connected to one of said first and second tubing members and means forming a second conduit extending within said body and adapted to be connected to the other of said first and second tubing members, port means in said body for communicating fluid between one of said conduits and said cavity and further port means in said body for communicating one of said conduits with the exterior of said seal member for discharging evacuation fluid into said wellbore between said seal member and said wellhead means when said seal member is diposed in said wellbore in its working condition.

9. The apparatus set forth in claim 1 wherein:

said first tubing member is diposed within said second tubing member in concentric relationship, and said tubing string includes plural sections of tubing comprising said first tubing member and said second tubing member, said tubing sections each being characterized by said first tubing member including at its opposite ends, respectively, receiver means and stabbing means for coupling said first tubing members to corresponding first tubing members of successive sections of said tubing string when said sections are coupled in end-to-end relationship.

10. Apparatus for evacuating solids such as sediment, sand and the like from a subterranean wellbore, said apparatus comprising:

a first elongated tubing string extendable into said wellbore, said first tubing string including a first tubing member forming a flow path for conducting solids evacuation fluid to said wellbore and a second tubing member for conducting solids laden fluid from said wellbore;

pump means operably connected to said first and second tubing members to receive evacuation fluid from one of said tubing members and to conduct solids laden evacuation fluid to the other of said tubing members, said pump means including means for jetting a portion of said evacuation fluid into said wellbore to entrain solids in said evacuation fluid, said pump means being operated by a further portion of said evacuation fluid to discharge solids laden evacuation fluid into said other tubing member for removal of solids from said wellbore;

a seal member operably connected to said first tubing member and said second tubing member and adapted to be interposed in said wellbore, said seal member including sealing means for engaging a wall surface defining said wellbore to seal off a portion of said wellbore to be evacuated of solids from a further portion of said wellbore;

a second tubing string extending between said seal member and wellhead means; and a fluid flow passage formed in said further portion of said wellbore between said seal member and said wellhead means whereby evacuation fluid is conducted between said seal member and said one tubing member and by way of said other tubing member, said seal member and said second tubing string.

11. Apparatus for conducting evacuation fluid to a wellbore to evacuate sediment, sand and other solids accumulations in said wellbore, said apparatus comprising:

a hydraulic jet pump adapted to be inserted in said wellbore and connected to a tubing string having first and second tubing members for conducting evacuation fluid to and evacuation fluid from said jet pump, respectively, said jet pump including an elongated body having a first flow passage formed therein and in communication with one of said tubing members for receiving solids evacuation fluid, jet nozzle means in communication with said first passage for jetting evacuation fluid into said wellbore to agitate and entrain solids into a flowstream of said evacuation fluid, an inlet cavity formed in said body for receiving solids laden evacuation fluid, means forming a discharge passage for discharging solids laden evacuation fluid from said pump to the other of said tubing members and an eductor in flow communication with said inlet cavity for receiving at least some of said evacuation fluid conducted to said pump for entraining said solids laden evacuation fluid for pumping said solids laden evacuation fluid through said discharge passage from said wellbore.

12. The apparatus set forth in claim 11 wherein:

said jet nozzle means comprises an array of jet nozzles disposed for discharging fluid from a distal end of said pump and around said inlet cavity.

13. A method for removing accumulations of solids such as sediment, sand and proppant materials from a wellbore, said method comprising in the steps of:

providing jet pump means including means for connecting said pump means to a first conduit for receiving evacuation fluid in said pump means and a second conduit for discharging solids laden evacuation fluid from said pump means, said pump means including means for circulating evacuation fluid into said wellbore to accumulate solids for evacuation from said wellbore through said pump means;

providing a tubing string including a first elongated tubing member adapted to be connected at one end to said pump means;

extending said pump means into said wellbore connected to one end of said tubing string;

inserting a second tubing member within said first tubing member and connecting one end of said second tubing member to said pump means;

connecting said first and second tubing members to means for conducting evacuation fluid to and from said pump means through said tubing string; and circulating said evacuation fluid into and out of a selected area of said wellbore through said first tubing member, said pump means and said second tubing member to remove accumulations of solids from said selected area of said wellbore.

14. The method set forth in claim 13 including the steps of:

providing a seal member adapted to be connected to said tubing string and insertable in said wellbore;

inserting said seal member in said wellbore connected to the end of said tubing string opposite said pump means and connected to tubing means extending between said seal member and the earth's surface; and circulating evacuation fluid between the earth's surface and said pump means through said tubing means, said seal member and a portion of said wellbore between said seal member and the earth's surface.

15. The method set forth in claim 14 wherein:

said seal member includes means for conducting fluid between said portion of said wellbore and said first tubing member, and the step of circulating said evacuation fluid includes conducting evacuation fluid from the earth's surface through said portion of said wellbore, said seal member and said first tubing member to said selected area of said wellbore and then through said pump means, said second tubing member and said tubing means toward the earth's surface.

16. The method set forth in claim 14 wherein:

said seal member includes means for conducting fluid between said wellbore and said second tubing member, and the step of circulating said evacuation fluid includes conducting evacuation fluid through said tubing means, said seal member and said second tubing member to said selected area of said wellbore and then through said pump means, said first tubing member, said seal member and said portion of said wellbore toward the earth's surface.

17. The method set forth in claim 14 including the step of:

positioning said seal member in a generally vertical portion of said wellbore so as to provide said portion of said wellbore extending between said seal member and the earth's surface.

* * * * *